US009375103B1

(12) United States Patent
Hoppaugh et al.

(10) Patent No.: US 9,375,103 B1
(45) Date of Patent: Jun. 28, 2016

(54) ILLUMINATED IMAGE ASSEMBLY

(71) Applicants: David R. Hoppaugh, Mooringsport, LA (US); Shelley M. Hoppaugh, Mooringsport, LA (US)

(72) Inventors: David R. Hoppaugh, Mooringsport, LA (US); Shelley M. Hoppaugh, Mooringsport, LA (US)

( * ) Notice: Subject to any disclaimer, the term of this patent is extended or adjusted under 35 U.S.C. 154(b) by 0 days.

(21) Appl. No.: 14/283,688

(22) Filed: May 21, 2014

(51) Int. Cl.
*A47G 1/06* (2006.01)
*G09F 13/22* (2006.01)

(52) U.S. Cl.
CPC ..... *A47G 1/0622* (2013.01); *G09F 13/22* (2013.01)

(58) Field of Classification Search
CPC ..... A47G 1/0622; B42F 5/06
USPC ..... 40/544, 547, 714, 778, 782, 732
See application file for complete search history.

(56) References Cited

U.S. PATENT DOCUMENTS

| | | | | |
|---|---|---|---|---|
| 2,529,713 | A | 11/1950 | Thurston | |
| 3,318,032 | A * | 5/1967 | Robison et al. | 40/714 |
| 4,096,656 | A | 6/1978 | Diceglie | |
| 4,819,353 | A | 4/1989 | Glucksman et al. | |
| 5,162,696 | A * | 11/1992 | Goodrich | 313/511 |
| 5,412,887 | A | 5/1995 | Layne | |
| 5,555,654 | A | 9/1996 | Hermann | |
| 6,557,283 | B1 * | 5/2003 | Canfield | G09F 13/04 40/545 |
| 7,107,712 | B2 | 9/2006 | Mueller | |
| 7,559,664 | B1 | 7/2009 | Walleman et al. | |
| 8,151,500 | B2 | 4/2012 | Lin | |
| 2002/0040541 | A1 | 4/2002 | Wang | |
| 2004/0049962 | A1 | 3/2004 | Moshirnoroozi | |
| 2006/0090384 | A1 * | 5/2006 | Woodruff | 40/544 |
| 2008/0120882 | A1 | 5/2008 | Mueller | |
| 2009/0019752 | A1 | 1/2009 | Liao | |

* cited by examiner

*Primary Examiner* — Joanne Silbermann
(74) *Attorney, Agent, or Firm* — R. Keith Harrison

(57) ABSTRACT

An illuminated image assembly includes an assembly frame; an illumination insert including an insert frame disposed within the assembly frame and a plurality of LEDs embedded within the insert frame and extending along an entire perimeter of the insert frame; and at least one image carried by the assembly frame in light-receiving relationship to the plurality of LEDs.

18 Claims, 8 Drawing Sheets

ILLUMINATED IMAGE ASSEMBLY

FIELD

Illustrative embodiments of the disclosure generally relate to illuminated images. More particularly, illustrative embodiments of the disclosure relate to an illuminated image assembly which uniformly illuminates a photograph, painting, drawing or other image.

BACKGROUND

The background description provided herein is solely for the purpose of generally presenting the context of the illustrative embodiments of the disclosure. Aspects of the background description are neither expressly nor impliedly admitted as prior art against the claimed subject matter.

Images such as photographs, paintings and drawings are often displayed in a frame which is hung on a wall. Framed images are typically not illuminated. However, illumination may enhance the visual appeal, appreciation and enjoyment of the images.

Accordingly, an illuminated image assembly which uniformly illuminates a photograph, painting, drawing or other image may be desirable for some applications.

SUMMARY

Illustrative embodiments of the disclosure are generally directed to an illuminated image assembly which uniformly illuminates a photograph, painting, drawing or other image. An illustrative embodiment of the illuminated image assembly includes an assembly frame; an illumination insert including an insert frame disposed within the assembly frame and a plurality of LEDs embedded within the insert frame and extending along an entire perimeter of the insert frame; and at least one image carried by the assembly frame in light-receiving relationship to the plurality of LEDs.

BRIEF DESCRIPTION OF THE DRAWINGS

Illustrative embodiments of the disclosure will now be described, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable users skilled in the art to practice the disclosure and are not intended to limit the scope of the claims. Moreover, the illustrative embodiments described herein are not exhaustive and embodiments or implementations other than those which are described herein and which fall within the scope of the appended claims are possible. Furthermore, there is no intention to be bound by any expressed or implied theory presented in the preceding technical field, background, brief summary or the following detailed description. Relative terms herein, such as "front" and "rear", are used with reference to relative positions of various elements with respect to each other in exemplary application of the illuminated image assembly and are not intended to be used in a limiting sense.

Figure 1:
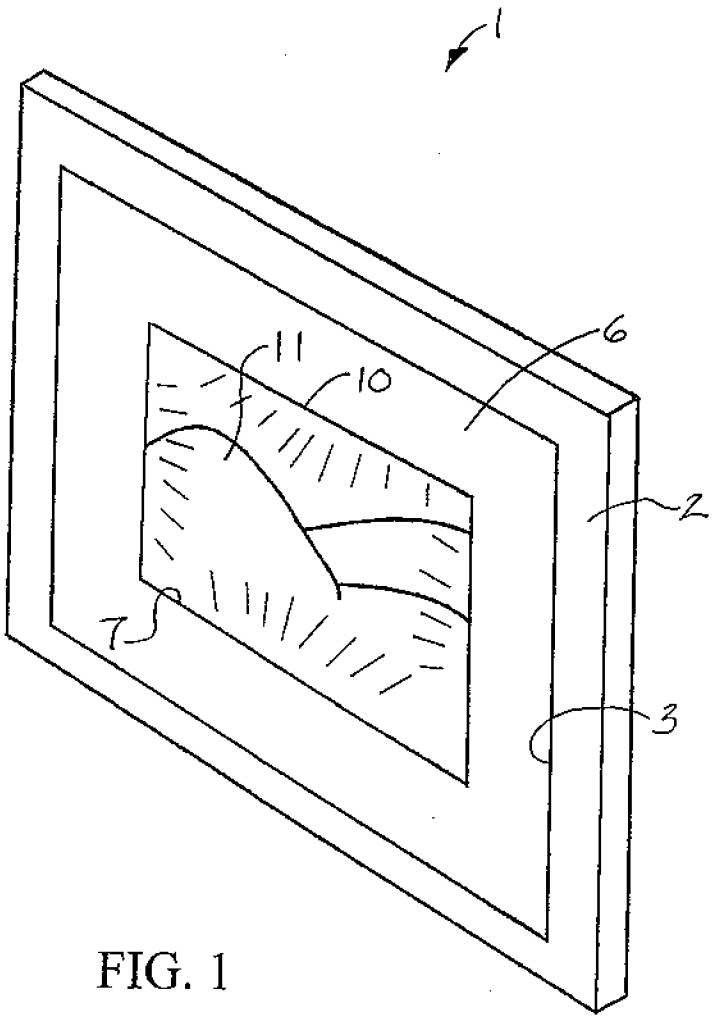
FIG. 1 is a front perspective view of an illustrative embodiment of the illuminated image assembly.

Referring to the drawings, an illustrative embodiment of the illuminated image assembly is generally indicated by reference numeral 1. As illustrated in FIG. 1 and will be hereinafter described, the illuminated image assembly 1 is adapted to uniformly illuminate at least one image 11 such as a photograph, painting, drawing or the like. In some embodiments, the illuminated image assembly 1 may be adapted to illuminate the image 11 in one or more of a plurality of selected colors. In some embodiments, the illuminated image assembly 1 may be adapted to illuminate the image 11 via remote control, as will be hereinafter described.

Figure 2:
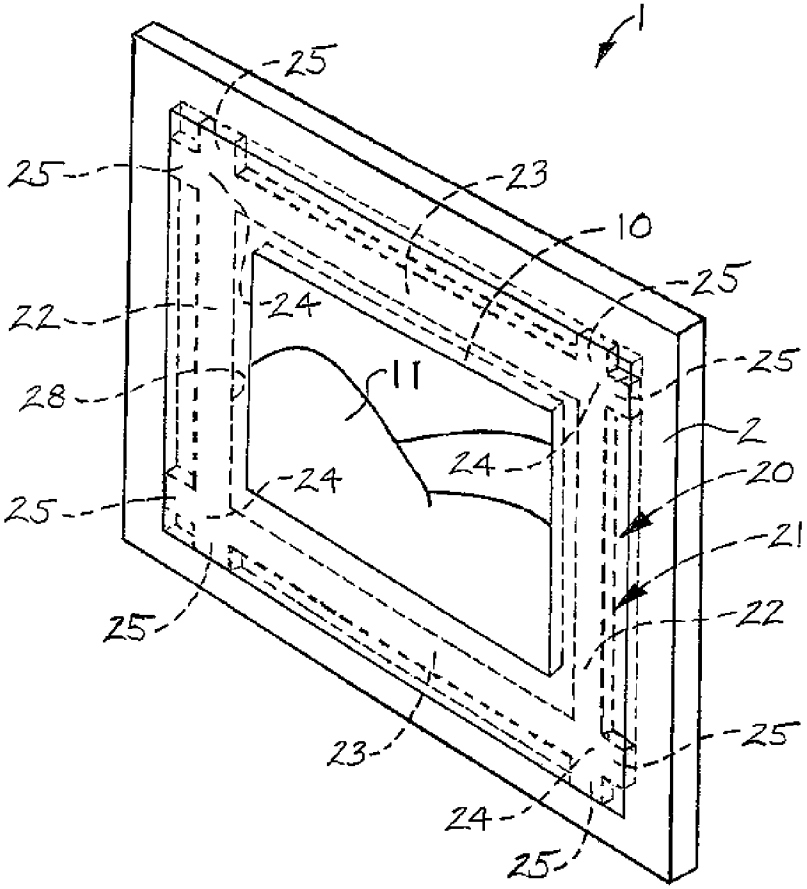
FIG. 2 is a front perspective view of the illustrative illuminated image assembly with an exemplary illumination insert of the assembly illustrated in phantom.
Figure 3:
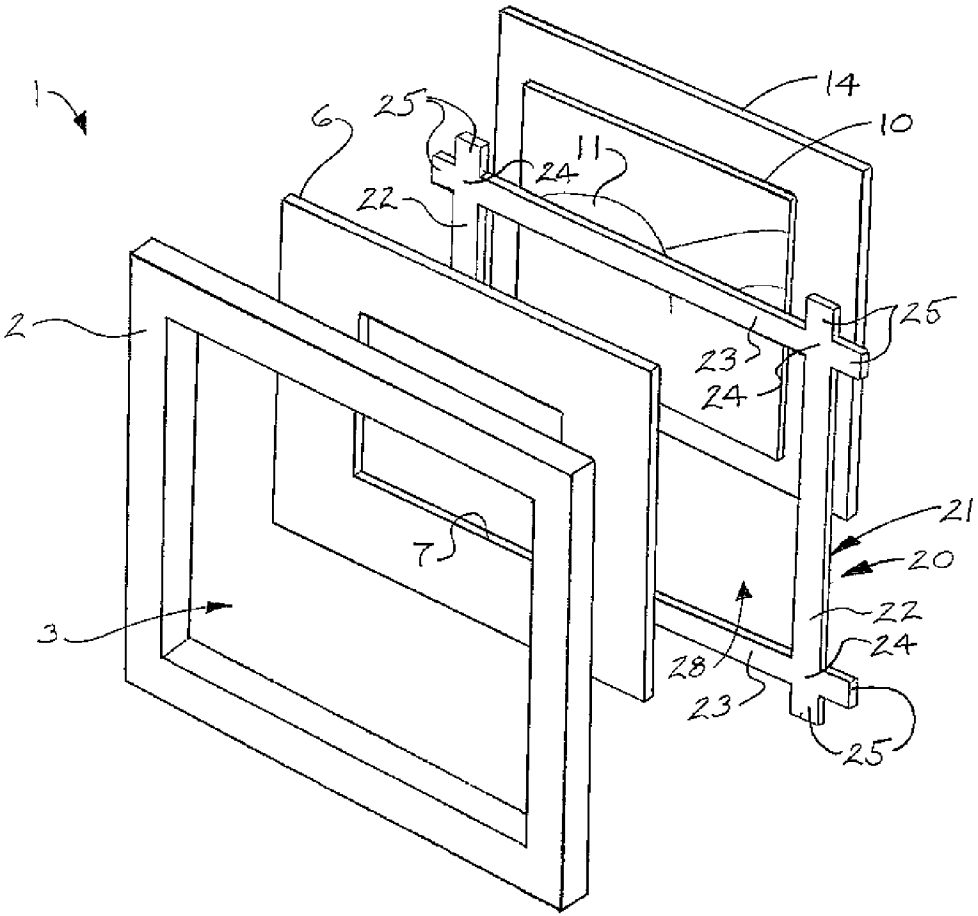
FIG. 3 is an exploded front perspective view of the illustrative illuminated image assembly.
Figure 4:
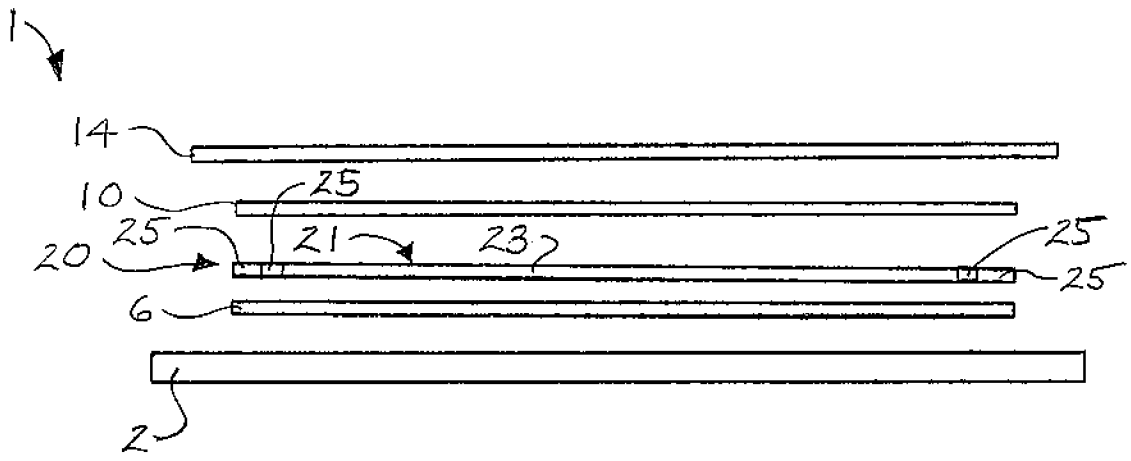
FIG. 4 is an exploded top view of the illustrative illuminated image assembly.

As illustrated in FIGS. 2-4, the illuminated image assembly 1 includes an assembly frame 2 having an assembly frame opening 3. In some embodiments, the assembly frame 2 may be generally rectangular. In other embodiments, the assembly frame 2 may be circular, square, triangular, pentagonal, hexagonal or other polyhedral shape. The assembly frame 2 may include plastic, metal, wood, fiberglass, composite and/or any other suitable material or combination of materials.

An assembly mat 6 having an assembly mat opening 7 may be supported within the assembly frame opening 3 of the assembly frame 2 using adhesives and/or mechanical fasteners such as screws or stables, for example and without limitation. The assembly mat 6 may have a shape which is the same as and a size which is slightly smaller than the assembly frame opening 3. The assembly mat 6 may include plastic, metal, wood, fiberglass, composite, cardboard, fiberboard and/or any other suitable material or combination of materials. In some embodiments, a glass cover panel (not illustrated) may be provided over or within the assembly mat opening 7 of the assembly mat 6.

Figure 5:
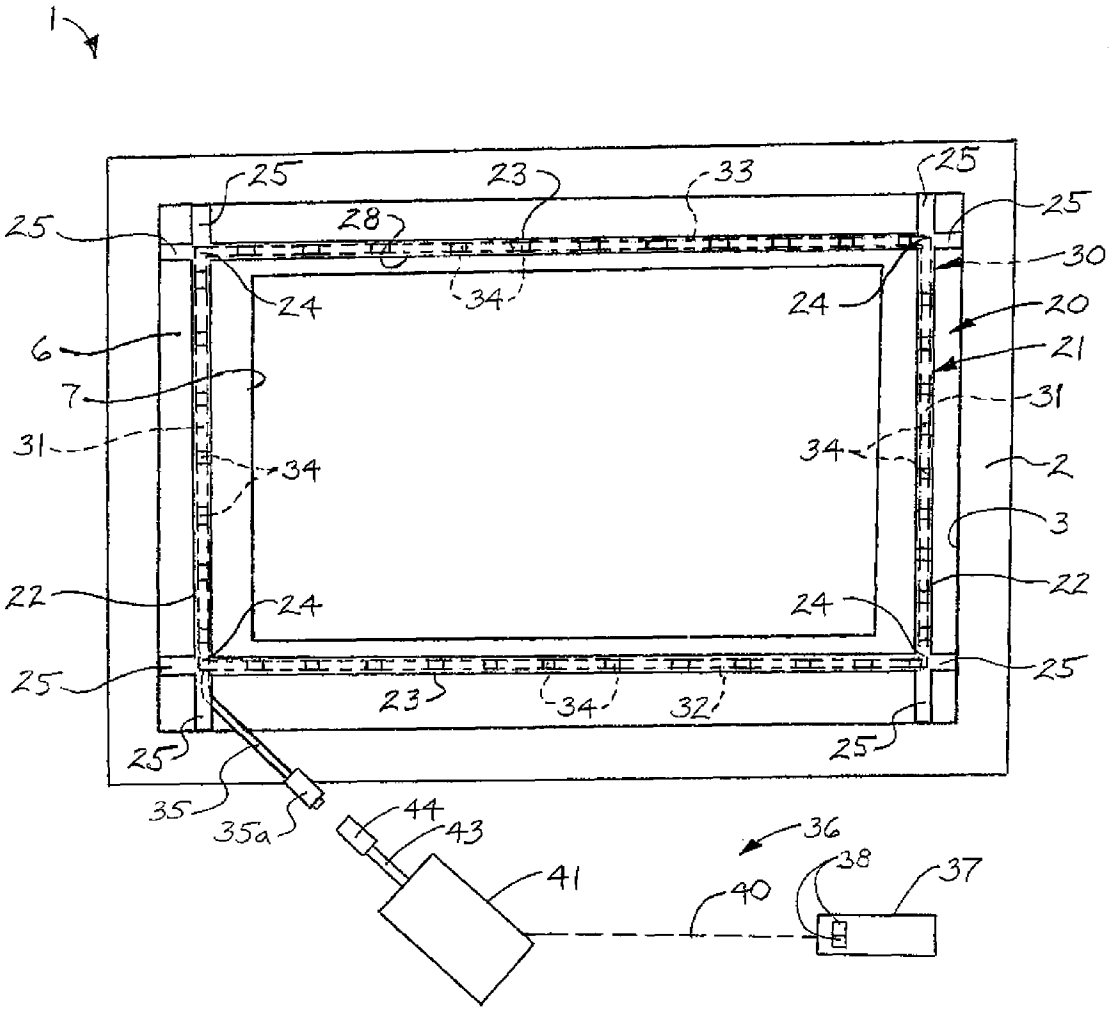
FIG. 5 is a rear view of an exemplary illumination insert seated in an assembly frame of the illustrative illuminated image assembly, more particularly illustrating exemplary remote activation of the illumination insert.
Figure 6:
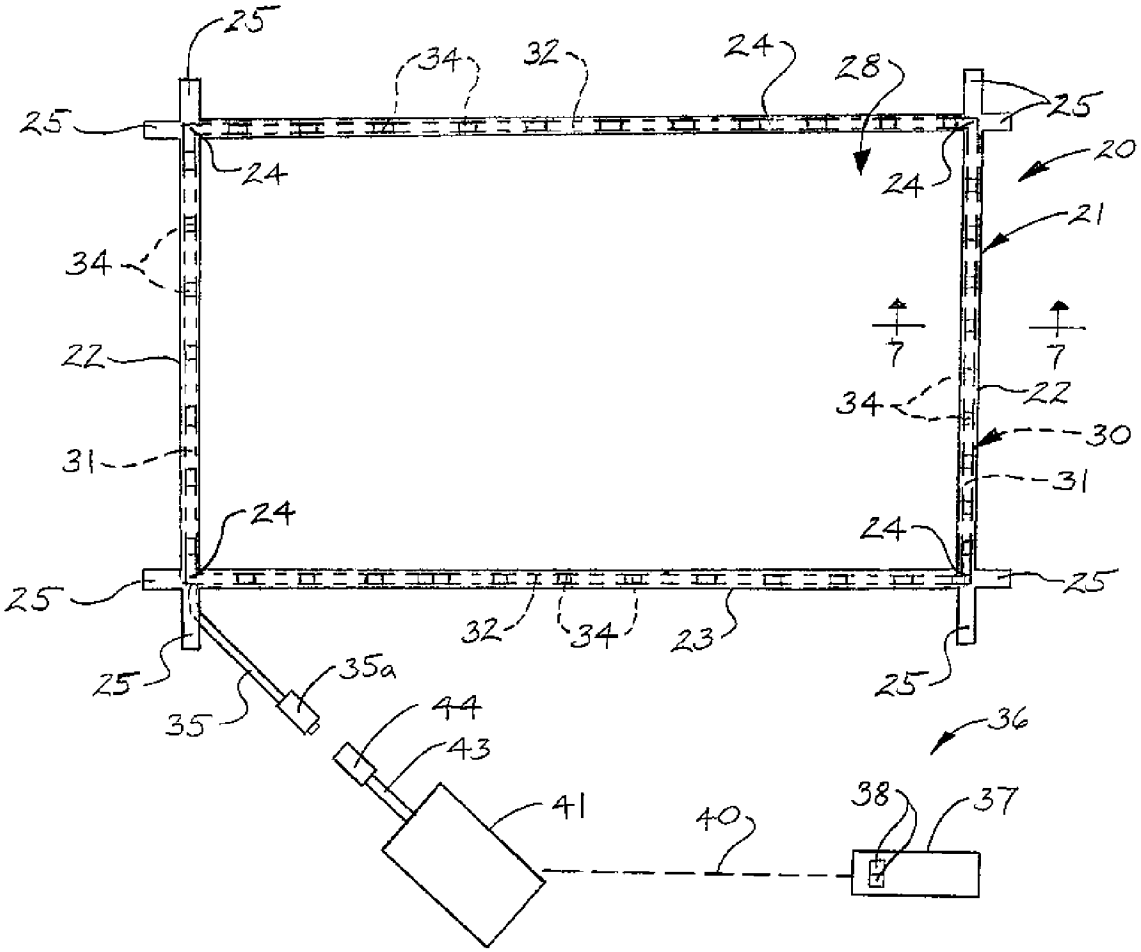
FIG. 6 is a front view of the exemplary illumination insert, more particularly illustrating exemplary remote activation of the illumination insert.
Figure 7:
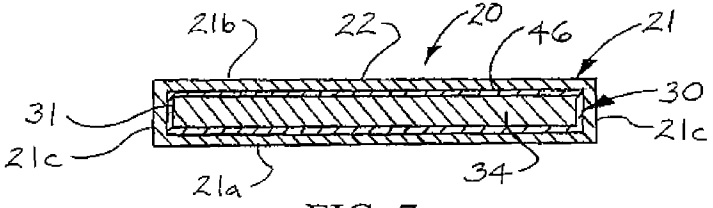
FIG. 7 is a sectional view, taken along section lines 7-7 in FIG. 6, of a side insert frame member of the illumination insert.

As illustrated in FIGS. 5-8, an illumination insert 20 is disposed within the frame opening 3 of the assembly frame 2. The illumination insert 20 may be disposed behind the assembly mat 6. The illumination insert 20 includes an insert frame 21 which may generally correspond to the shape of the assembly frame 2. Accordingly, in some embodiments, the insert frame 21 may be generally rectangular with a pair of spaced-apart, parallel side insert frame members 22; a pair of spaced-apart, parallel transverse insert frame members 23 which extend between the side insert frame members 22; and insert frame corners 24 at the junctions between the side insert frame members 22 and the transverse insert frame member 23. As illustrated in FIG. 7, the insert frame 21 may have a generally rectangular cross-section with a front insert frame surface 21*a* which faces the assembly mat 6, a rear insert frame surface 21*b*, an inner insert frame edge 21*c* which faces the insert frame opening 28 and an outer insert frame edge 21*d* which is opposite the inner insert frame edge 21*c*. The insert frame 21 may be fabricated of a transparent, translucent or opaque glass or plastic material using a molding or other suitable fabrication process known by those skilled in the art.

In some embodiments, a pair of insert frame stand-offs 25 may extend from each insert frame corner 24 of the insert frame 21. The insert frame stand-offs 25 at each insert frame corner 24 may be oriented in generally perpendicular relationship to each other. As illustrated in FIGS. 2 and 5, in the assembled illuminated image assembly 1, the insert frame stand-offs 25 may engage the interior surfaces of the assembly frame opening 3 to center the insert frame 21 in the assembly frame 2.

Multiple LEDs 34 are embedded within the insert frame 21 of the illumination insert 20. Accordingly, as illustrated in FIG. 7, the LEDs 34 may be disposed between the front insert frame surface 21*a*, the rear insert frame surface 21*b*, the inner insert frame edge 21*c* and the outer insert frame edge 21*d* of the insert frame 21. The LEDs 34 may extend around the entire perimeter of the insert frame 21. In some embodiments, the LEDs 34 may be adapted to emit light of various colors as is known by those skilled in the art.

Figure 8:
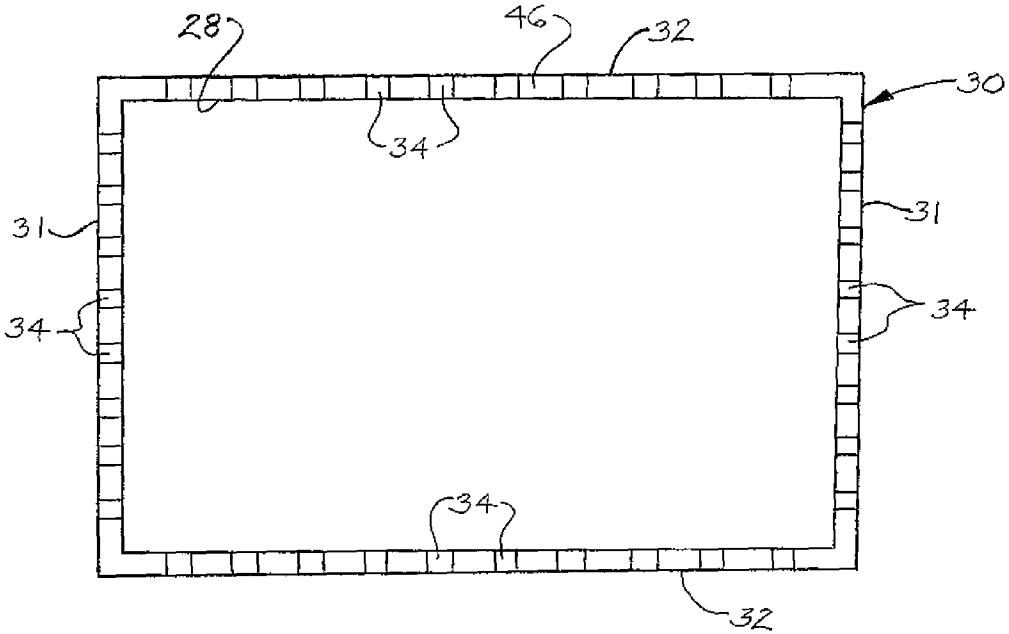
FIG. 8 is a front view of an exemplary LED strip of the illumination insert.

As illustrated in FIG. 8, in some embodiments, the LEDs 34 may be provided in an LED strip 30 which extends within and along the perimeter of the insert frame 21. The LED strip 30 may include a strip body 46 made of plastic or other material with multiple LEDs 34 embedded in or supported by the strip body 46 at spaced-apart intervals to each other. The LED strip 30 may include a pair of side strip segments 31 which are embedded in the respective side insert frame members 22 and a pair of transverse strip segments 32 which are embedded in the respective transverse insert frame members 23 of the insert frame 21. An example of an LED strip 30 which is suitable for the purpose can be obtained from Elemental LED.

Figure 9:
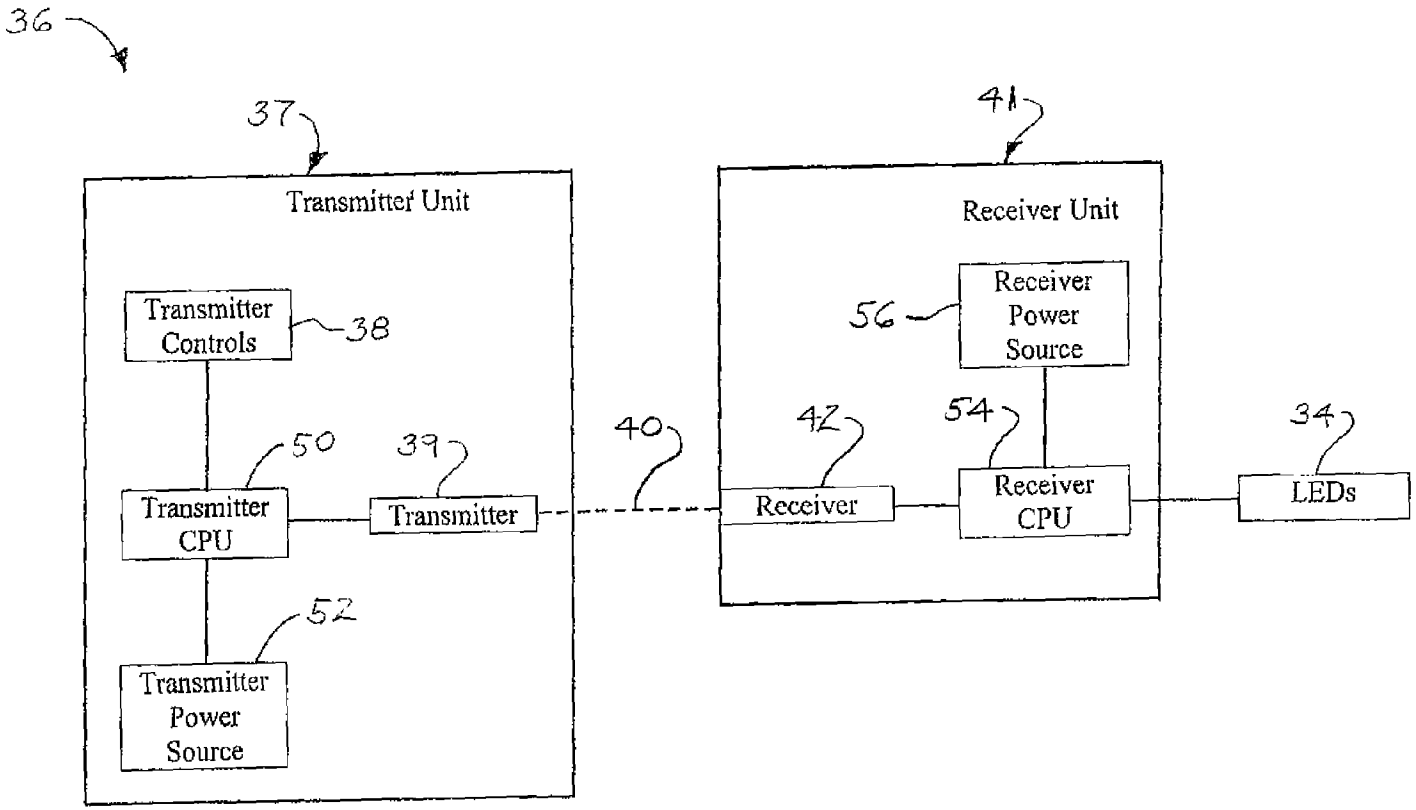
FIG. 9 is a block diagram of an exemplary illumination control system suitable for implementation of the illuminated image assembly.

As illustrated in FIGS. 5, 6 and 9, an illuminator control system 36 may facilitate selective control operation of the LEDs 34 in the illumination insert 20 of the illuminated image assembly 1. The illuminator control system 36 may have any design which is known by those skilled in the art and is suitable for the purpose. In some embodiments, the illuminator control system 36 may facilitate selective remote control operation of the LEDs 34. Accordingly, the remote illuminator control system 36 may include a receiver unit 41 which electrically interfaces with the LEDs 34 such as through a receiver cable 43 which extends from the receiver unit 41 and may be detachably coupled to an LED cable 35 (FIGS. 5 and 6) which is connected to the LEDs 34 through a receiver cable coupling 44 and an LED cable coupling 35*a*. A transmitter unit 37 may interface wirelessly with the receiver unit 41 through wireless transmission signals 40. The transmitter unit 37 may facilitate selective illumination of the LEDs 34 in the illumination insert 20 through the receiver unit 41, as will be hereinafter described.

An example of a transmitter unit 37 and a receiver unit 41 which are suitable for the remote illumination control system 36 is illustrated in FIG. 9. The transmitter unit 37 may include a transmitter CPU 50. A transmitter power source 52, such as at least one battery, for example and without limitation, interfaces with the transmitter CPU 50. A transmitter 39 interfaces with the transmitter CPU 50 and emits the wireless transmission signals 40. Transmitter controls 38 may interface with the transmitter CPU 50. The transmitter controls 38 may facilitate selective user-actuated illumination of the LEDs 34 as well as the selected color of the LEDs 34 when illuminated.

The receiver unit 41 may include a receiver 42 which receives the wireless transmission signals 40 from the transmitter 39 of the transmitter unit 37. A receiver CPU 54 may interface with the receiver 42. A receiver power source 56, such as at least one battery, for example and without limitation, interfaces with the receiver CPU 54. Accordingly, a user may select the color of light which is to be emitted from the LEDs 34 by appropriate manipulation of the transmitter controls 38 on the transmitter unit 37. The transmitter unit CPU 50 transmits a transmitter activation signal (not illustrated) to the transmitter 39. In response, the transmitter 39 transmits the wireless transmission signals 40 in which the selected color of the LEDs 34 is encoded to the receiver 42 of the receiver unit 41. Upon receiving the wireless transmission signals 40 from the transmitter unit 37, the receiver 42 transmits a receiver activation signal (not illustrated) to the receiver CPU 54. The receiver CPU 54 transmits an LED activation signal (not illustrated) which energizes and illuminates the LEDs 34 in the color which was selected by the user via the transmitter controls 38 of the transmitter unit 37.

It will be recognized and understood by those skilled in the art that the remote illuminator control system 36 heretofore described with respect to FIGS. 5, 6 and 9 is a non-limiting example of an illuminator control system which is suitable for operation of the illuminated image assembly 1. In alternative embodiments, the illuminator control system 36 may include any hardware with controls which enable a user to selectively energize and illuminate the LEDs 34 and select the illumination color of the LEDs 34.

As illustrated in FIGS. 3 and 4, in some embodiments, the image 11 may be provided on an image panel 10. The image panel 10 may include plastic, metal, wood, fiberglass, composite, cardboard, fiberboard and/or any other suitable material or combination of materials. The image 11 may be applied to the image panel 10 as a photograph, a drawing, a painting or any other image which is to be displayed and illuminated by operation of the illumination insert 20, as will be hereinafter further described.

A backing panel 14 may be supported by the assembly frame 2 using adhesives and/or mechanical fasteners, for example and without limitation. The backing panel 14 may include plastic, metal, wood, fiberglass, composite, cardboard, fiberboard and/or any other suitable material or combination of materials. The backing panel 14 may support the image panel 10 and the image 1 in the frame opening 3 of the assembly frame 2 as will be hereinafter described.

As illustrated in FIGS. 3 and 4, the illuminated image assembly 1 may be assembled by inserting and securing the assembly mat 6 in the assembly frame opening 3 of the assembly frame 2. The insert frame 21 of the illumination insert 20 may then be inserted in the rear of the assembly frame opening 3 and placed against the assembly mat 6, as illustrated in FIG. 5, with the insert frame stand-offs 25 engaging the interior surfaces of the assembly frame 2. Next, the image panel 10 may be placed in the insert frame opening 28 in the insert frame 21 of the illumination insert 20 with the image 11 visible through the assembly mat opening 7 of the assembly mat 6. The backing panel 14 may then be placed against the illumination insert 20 and secured to the assembly frame 2 using clips and/or other fasteners (not illustrated).

The LEDs 34 in the illumination insert 20 may be energized and illuminated by manipulation of the transmitter controls 38 (FIG. 9) on the transmitter unit 37. In some embodiments, the color of the LEDs 34 may also be selected by manipulation of the transmitter controls 38. Accordingly, as illustrated in FIG. 1, the LEDs 34 uniformly illuminate the image 10 in the selected color to enhance the aesthetic appearance of the image 10 through the assembly mat opening 7 of the assembly mat 6.

It will be appreciated by those skilled in the art that the insert frame stand-offs 25 at the respective insert frame corners 24 of the insert frame 21 engage the interior surfaces of the assembly frame opening 3 to center the insert frame 21 in the assembly frame 2. Accordingly, the LEDs 34 may be maintained at the same distance from the image 11 at all points along the perimeter of the insert frame 21. This expedient may facilitate uniform illumination of the image 11 at all points along the sides, top and bottom of the image 11. Moreover, embedding the LEDs 34 in the insert frame 21 of the illumination insert 20 may facilitate uniform scattering and emission of light from the LEDs 34, further enhancing the uniform illumination of the image 11.

While illustrative embodiments of the disclosure have been described above, it will be recognized and understood that various modifications can be made and the appended claims are intended to cover all such modifications which may fall within the spirit and scope of the disclosure.

What is claimed is:

1. An illuminated image assembly, comprising:
an assembly frame;
an illumination insert including:
an insert frame disposed within the assembly frame, the insert frame having a plurality of insert frame corners;
an LED strip having a strip body and a plurality of LEDs embedded in the strip body, the LED strip completely embedded within the insert frame and extending along an entire perimeter of the insert frame;
at least one image carried by the assembly frame in light-receiving relationship to the plurality of LEDs; and
a pair of elongated insert frame stand-offs extending from the insert frame of the illumination insert at each of the plurality of insert frame corners, the insert frame stand-offs engaging the assembly frame and centering the insert frame in the assembly frame, the pair of insert frame stand-offs at each of the plurality of insert frame corners oriented in generally perpendicular relationship to each other and extending beyond the insert frame.

2. The illuminated image assembly of claim 1 further comprising an illumination control system interfacing with the plurality of LEDs.

3. The illuminated image assembly of claim 2 wherein the illumination control system comprises a receiver unit interfacing with the plurality of LEDs and a transmitter unit wirelessly interfacing with the receiver unit.

4. The illuminated image assembly of claim 1 wherein the plurality of LEDs are adapted to selectively emit light of various colors.

5. The illuminated image assembly of claim 1 further comprising a backing panel carried by the assembly frame.

6. The illuminated image assembly of claim 1 further comprising an assembly mat having an assembly mat opening carried by the assembly frame, and wherein the image is visible through the assembly mat opening.

7. The illuminated image assembly of claim 1 wherein the assembly frame is rectangular.

8. An illuminated image assembly, comprising:
an assembly frame;
an illumination insert including:
an insert frame disposed within the assembly frame, the insert frame having a front insert frame surface, a rear insert frame surface and inner and outer insert frame edges between the front insert frame surface and the rear insert frame surface and a plurality of insert frame corners; and
an LED strip having a strip body and a plurality of LEDs embedded in the strip body, the LED strip completely embedded within the insert frame between the front surface, the rear surface and the inner and outer edges, the plurality of LEDs coextensive with and extending along an entire perimeter of the insert frame;
at least one image carried by the assembly frame in light-receiving relationship to the plurality of LEDs; and
a pair of elongated insert frame stand-offs extending from the insert frame of the illumination insert at each of the plurality of insert frame corners, the insert frame stand-offs engaging the assembly frame and centering the insert frame in the assembly frame, the pair of insert frame stand-offs at each of the plurality of insert frame corners oriented in generally perpendicular relationship to each other and extending beyond the insert frame.

9. The illuminated image assembly of claim 8 further comprising an illumination control system interfacing with the plurality of LEDs.

10. The illuminated image assembly of claim 9 wherein the illumination control system comprises a receiver unit interfacing with the plurality of LEDs and a transmitter unit wirelessly interfacing with the receiver unit.

11. The illuminated image assembly of claim 8 wherein the plurality of LEDs are adapted to selectively emit light of various colors.

12. The illuminated image assembly of claim 8 further comprising a backing panel carried by the assembly frame.

13. The illuminated image assembly of claim 8 further comprising an assembly mat having an assembly mat opening carried by the assembly frame, and wherein the image is visible through the assembly mat opening.

14. The illuminated image assembly of claim 8 wherein the assembly frame is rectangular.

15. An illuminated image assembly, comprising:
an assembly frame having an assembly frame opening;
an illumination insert including:
an insert frame disposed within the assembly frame opening of the assembly frame, the insert frame having an insert frame opening, a front insert frame surface, a rear insert frame surface, an inner insert frame edge facing the insert frame opening, an outer insert frame edge opposite the inner insert frame edge, a plurality of elongated insert frame corners and a pair of insert frame stand-offs extending from the insert frame of the illumination insert at each of the plurality of insert frame corners, the pair of insert frame stand-offs at each of the plurality of insert frame corners oriented in generally perpendicular relationship to each other and extending beyond the insert frame and the insert frame stand-offs engaging the assembly frame and centering the insert frame in the assembly frame opening; and
an LED strip having a strip body and a plurality of LEDs embedded in the strip body, the LED strip completely embedded within the insert frame between the front insert frame surface, the rear insert frame surface and the inner and outer insert frame edges, the LED strip coextensive with and extending along an entire perimeter of the insert frame; and at least one image carried by the assembly frame in light-receiving relationship to the LED strip.

16. The illuminated image assembly of claim 15 further comprising an illumination control system interfacing with the plurality of LEDs in the LED strip, the illumination remote control system including receiver unit interfacing with the plurality of LEDs and a transmitter unit wirelessly interfacing with the receiver unit.

17. The illuminated image assembly of claim 15 further comprising a backing panel carried by the assembly frame.

18. The illuminated image assembly of claim 15 further comprising an assembly mat having an assembly mat opening carried by the assembly frame, and wherein the image is visible through the assembly mat opening.

* * * * *